US005431073A

United States Patent [19]

Gregory

[11] Patent Number: 5,431,073

[45] Date of Patent: Jul. 11, 1995

[54] CARTRIDGE CASING EXTRACTOR

[76] Inventor: Dennis Gregory, 145 Elm Street, Atikokan, Ontario, Canada, P0T 1C0

[21] Appl. No.: 202,811

[22] Filed: Feb. 28, 1994

[51] Int. Cl.[6] ..... B25B 27/00

[52] U.S. Cl. ..... 81/3.05

[58] Field of Search ..... 81/3.05; 294/93, 94, 294/99.1; 29/263, 264

[56] References Cited

U.S. PATENT DOCUMENTS

| | | | |
|---|---|---|---|
| 235,444 | 12/1880 | Marvin . | |
| 290,255 | 12/1883 | McDermott . | |
| 656,009 | 8/1900 | Bergersen . | |
| 832,364 | 10/1906 | Burton . | |
| 929,526 | 7/1909 | Whitman . | |
| 1,275,803 | 8/1918 | Wallace . | |
| 1,326,569 | 12/1919 | Burdett . | |
| 3,316,780 | 5/1967 | Herkner | 81/3.05 |

FOREIGN PATENT DOCUMENTS

| | | | |
|---|---|---|---|
| 71464 | 8/1945 | Norway | 81/3.05 |

*Primary Examiner*—D. S. Meislin

*Attorney, Agent, or Firm*—Murray E. Thrift; Adrian D. Battison; Stanley G. Ade

[57] ABSTRACT

A cartridge extractor for extracting broken cartridges from a firearm uses a core rod with an enlarged head. The head is cross slotted so that it will compress as it is being pushed through the broken cartridge and will expand once it has passed the end of the cartridge. A tapered from face on the head cams the head into its contracted position as it passes through the casing. A rearwardly facing shoulder on the cartridge engages the end of the cartridge casing when the head is passed through the casing. The back end of the rod is removably attached to a base that is the same in size and configuration as the base of the cartridge being extracted so that it will cooperate with the extraction mechanism of the firearm. A resilient spacer tube surrounds the rod between the base and the head to assist in centering the extractor in the cartridge.

6 Claims, 2 Drawing Sheets

CARTRIDGE CASING EXTRACTOR

FIELD OF THE INVENTION

The present invention relates to cartridge extractors.

BACKGROUND OF THE INVENTION

When using a firearm, a cartridge casing will occasionally be broken or jammed in the cartridge chamber. This happens specially with reloaded cartridges. Various devices have been designed in the past for dealing with this problem. Many of these are quite old and will not work properly with modem firearms and rimless cartridges.

Many of the earlier extractors are designed with a core mandrel having an enlarged head, and a surrounding segmented tube. Rearwardly facing shoulders are provided on the tube segments, near their ends. In use, the mandrel and tube are inserted into the broken casing and when the end of the tube passes the end of the casing, the mandrel is pulled back to expand the end of the tube so that the shoulders will engage the end of the casing. Further tension on the mandrel draws the end of the tube and the cartridge engaged by it from the chamber. The mandrel may be pulled by the firearm's cartridge extractor or by a separate lever working against the end of the breech. In another early device, the extractor is driven out using a cleaning rod.

The earlier systems are generally not usable with modem rimless cartridges. When inserting the extractor, the mandrel could be driven into the chamber far enough that the cartridge extractor could not engage the base of the mandrel to pull the extractor and cartridge from the chamber.

The object of the present invention is to provide a simple, effective extractor for modem firearms that does not require special tools or an expanding mandrel.

SUMMARY OF THE INVENTION

According to the present invention there is provided a cartridge extractor for extracting from a firearm a cartridge casing having a broken off base, said extractor comprising an elongate rod having axially spaced front and back ends, an enlarged head on the front end, the head having an annular shoulder facing towards the back end for engagement with the end of a cartridge to be extracted, a plurality of axial slots extending through the head and part way along the rod, and a base member on the rod at the back end thereof conforming in size and configuration to the base of the cartridge casing.

This mechanism is much simpler than the prior multipart extractors. The rod has sufficient strength to pull a jammed cartridge casing from the chamber. While the slots at the end of the rod allow the head to contract sufficiently to pass through the casing, the inherent resiliency of the rod causes the head to expand when it passes the cartridge end. The absence of a mandrel not only simplifies this device but also eliminates any possibility that a large mandrel will damage the barrel rifling. In terms of performance, the extractor is capable of using the full stroke of the firearm's extraction mechanism to draw out a jammed casing with a mandrel and tube arrangement, the first part of the extraction stroke is taken up in setting the mandrel.

To limit the penetration of the extractor into the cartridge casing, a resilient tube is placed on the rod, between the rod head and the base of the extractor to serve as a spacer. The tube engages the neck of the cartridge casing so that the base of the extractor rod is properly positioned in the breech. The tube also assists in centering the rod in a casing to be extracted.

In preferred embodiments of the invention, the base of the extractor is removable, to provide for the ready removal of the cartridge case when extracted.

BRIEF DESCRIPTION OF THE DRAWINGS

In the accompanying drawings, which illustrate an exemplary embodiment of the present invention.

DETAILED DESCRIPTION

Figure 4:
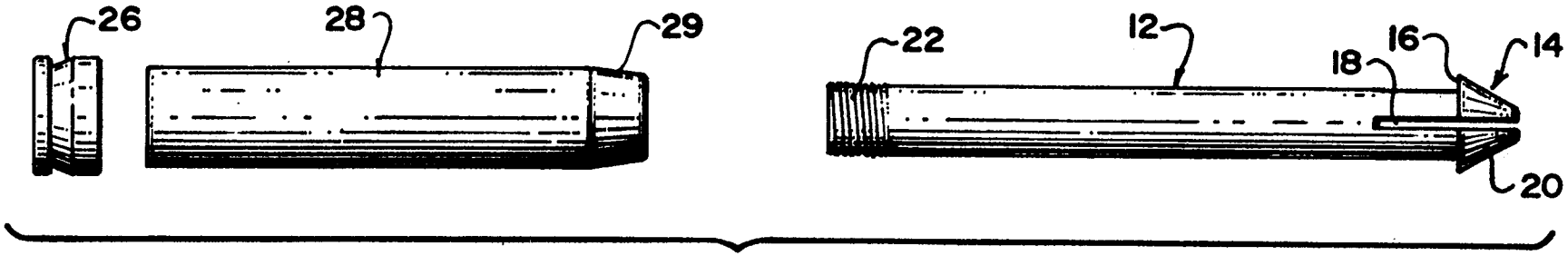
FIG. 4 is an exploded view showing the extractor in a disassembled condition.
Figure 2:
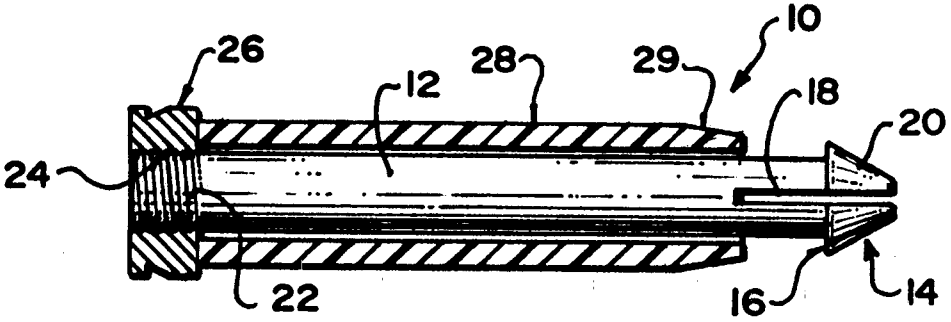
FIG. 2 is an axial view partly in cross-section of the extractor in FIG. 1.
Figure 3:
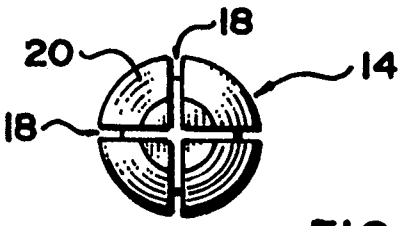
FIG. 3 is an elevation of the front end of the extractor.
Figure 1:
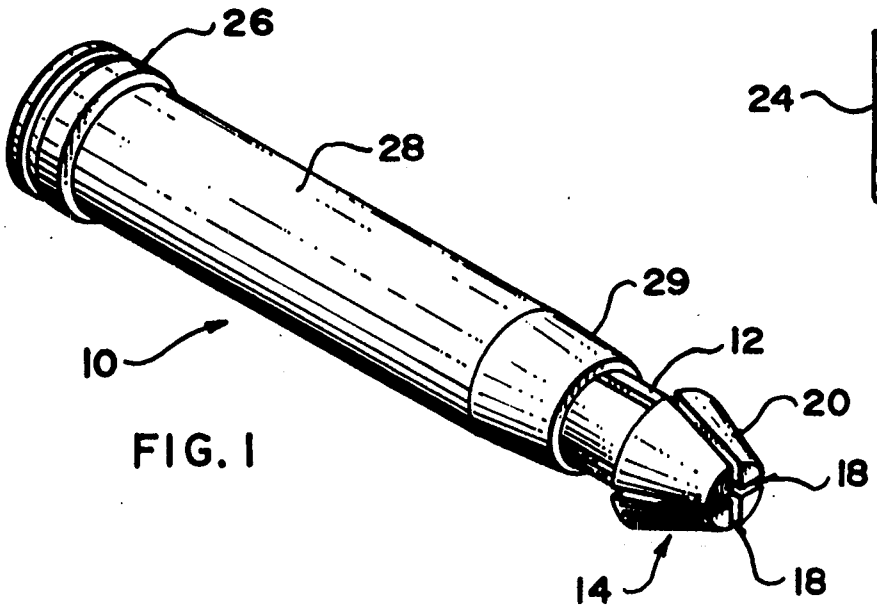
FIG. 1 is an isometric representation of an extractor according to the present invention.
Figure 5:
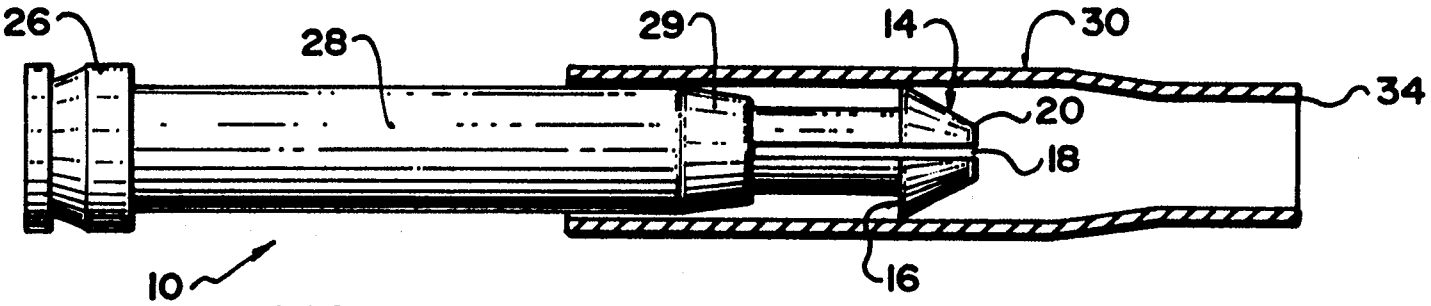
FIGS. 5, 6 and 7 show different stages in use of the extractor in cartridge extraction.
Figure 6:
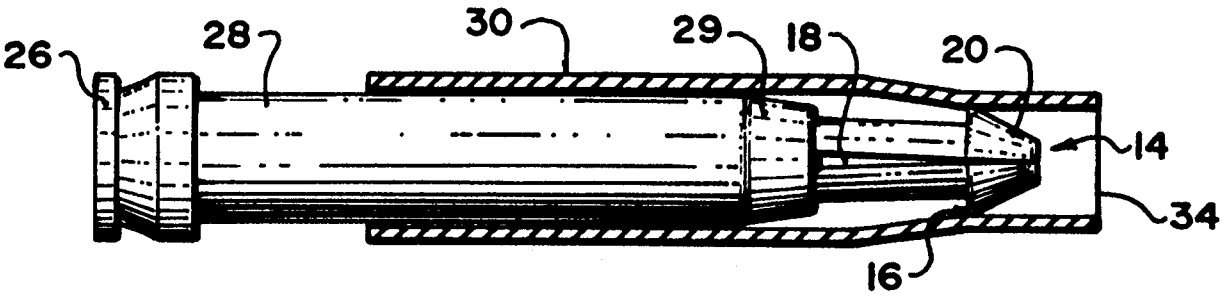
Figure 7:
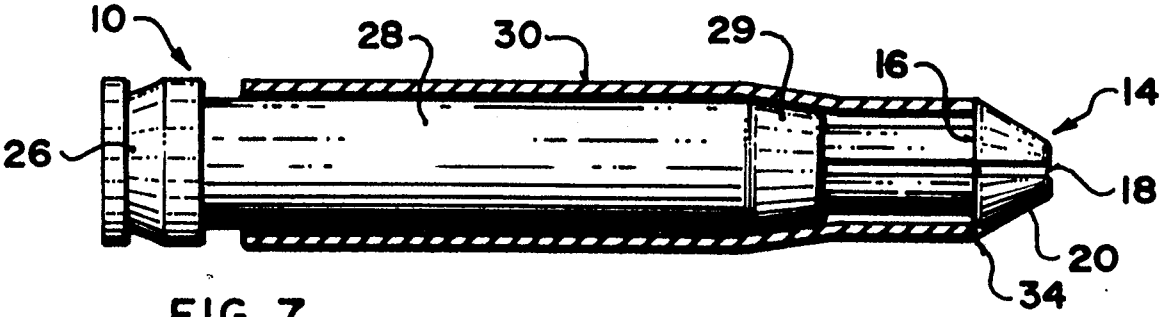

Referring to the accompanying drawings, there is illustrated a cartridge extractor 10. The extractor includes an elongate steel rod 12 with an enlarged head 14 at a front end of the rod. The head has an annular shoulder 16 facing towards the back end of the rod. Two diametrical, mutually perpendicular slots 18 extend from the front end of the rod through the head and part way along the body of the rod.

The head 14 has a frustoconical, forwardly tapered front face 20.

At the back end of the rod 12 is a threaded section 22 that screws into a threaded bore 24 in the center of a disc-like base 26. The base 26 has the same size and configuration as the base of a cartridge to be extracted by the extractor so that it will cooperate with the cartridge extractor of the firearm.

Surrounding the rod, between the base 26 and the shoulder 16 is a tubular spacer 28. The spacer is a compressible, resilient plastic tube. The leading end section 29 of the tube is tapered to a smaller diameter than the shoulder 16.

In use of the extractor, it is inserted into the base end of a broken cartridge casing 30 in the chamber of a firearm. As the head 14 of the extractor rod passes along the inside of the cartridge casing, it is cammed inwardly by the tapered front face 20. The slots 18 are sufficiently wide that the head may be contracted enough to pass through the complete cartridge casing. When the head has passed through the casing, it opens resiliently, with the shoulder 16 confronting the end 34 of the broken cartridge casing. The tube 28 is slightly longer in its relaxed state that the distance between the base and the tapered neck of the cartridge to be extracted. The leading end of the tube will thus engage the cartridge neck and limit penetration of the extractor base 26 into the cartridge chamber. The tube 28 also serves to center the rod in the cartridge casing. At this time, the breech of the firearm may be closed and reopened, thus engaging the firearm extractor mechanism with the base 26 of the extractor to pull the extractor and the cartridge casing 30 from the chamber.

Once the extractor and cartridge have been removed, it is a simple matter to unscrew the base of the extractor and to withdraw the cartridge from the extractor before the extractor is reassembled.

The actual sizes of the various components of the extractor will depend on the caliber of the cartridge casing to be extracted. The configuration of the bases will also vary depending on the configuration of the cartridge so as to cooperate properly with the extracting mechanism of the firearm.

While one embodiment of the present invention has been described in the foregoing, it is to be understood that other embodiments are possible within the scope of the invention. This invention is to be considered limited solely by the scope of the appended claims.

I claim:

1. A cartridge extractor for extracting from a firearm a cartridge casing having a neck and a base broken off at a position spaced from the neck, said extractor comprising:

an elongate rod having axially spaced front and back ends, an enlarged head on the front end of the rod, the head having an annular shoulder facing towards the back end for engagement with the end of the cartridge casing, a plurality of axial slots extending through the head and part way along the rod, a base member on the rod at the back end thereof conforming in size and configuration to the base of the cartridge casing; and a spacer comprising a resilient tube surrounding the rod between the head and the base member.

2. An extractor according to claim 1, the spacer having a leading end spaced from the base a distance no less than the normal spacing between the cartridge base and the neck of the cartridge.

3. An extractor according to claim 2 wherein the leading end of the spacer is tapered.

4. An extractor according to claim 1 wherein the base member is removably mounted on the rod.

5. An extractor according to claim 1 wherein the head has a tapered front end.

6. An extractor according to claim 1 wherein the slots comprise two slots, extending diametrically of the head, perpendicular to one another.

* * * * *